US005722387A

United States Patent [19]

Chen

[11] Patent Number: 5,722,387

[45] Date of Patent: Mar. 3, 1998

[54] PORTABLE STOVE

[76] Inventor: Yih-Long Chen, 58, Ma Yuan West St., Taichung, Taiwan

[21] Appl. No.: 729,860

[22] Filed: Oct. 15, 1996

[51] Int. Cl.[6] ..... F24C 5/04

[52] U.S. Cl. ..... 126/45; 126/43

[58] Field of Search ..... 126/43, 45

[56] References Cited

U.S. PATENT DOCUMENTS

| | | | |
|---|---|---|---|
| 520,498 | 5/1894 | Place | 126/45 |
| 5,273,023 | 12/1993 | Ebbeson | 126/45 |

*Primary Examiner*—Carroll B. Dority

[57] ABSTRACT

A portable stove has an upper disk, a lower disk, an oil can and three support rods disposed between the upper disk and the lower disk. Three boiler support plates are disposed on the upper disk. A boiler is disposed on the boiler support plates.

5 Claims, 3 Drawing Sheets

PORTABLE STOVE

BACKGROUND OF THE INVENTION

The invention relates to a stove. More particularly, the invention relates to a portable stove.

A conventional portable stove cannot be detached. It is cumbersome to carry the conventional portable stove outdoors. The portable stove will occupy a large room while it is not used.

SUMMARY OF THE INVENTION

An object of the invention is to provide a portable stove which is detachable.

Accordingly, a portable stove comprises an upper disk, a lower disk, an oil can and three support rods disposed between the upper disk and the lower disk. Three boiler support plates are disposed on the upper disk. Each of the boiler support plates has a lateral block, an indentation formed on an upper face of each boiler support plate, a reatangular bottom protrusion disposed beneath each boiler support plate, and a threaded post disposed beneath each reatangular bottom protrusion. The upper disk has three spaced rectangular holes to receive the corresponding threaded posts respectively, a plurality of vent holes and a center hole. Each of the support rods has an inner threaded hole formed on an upper end of each support rod to engage with the corresponding threaded post, an embossment formed on a middle portion of each support rod, and a threaded end disposed on a lower end of each support rod. The lower disk has a center recess, three spaced round holes to receive the corresponding threaded end respectively, and a plurality of curved recesses. An oil can is disposed on the center recess. A cylinder is disposed on the oil can. A wick is disposed in the cylinder. Three sockets are disposed beneath the lower disk. Each of the sockets has an inner threaded recess to engage with the corresponding threaded end respectively.

DETAILED DESCRIPTION OF THE INVENTION

Figure 1:
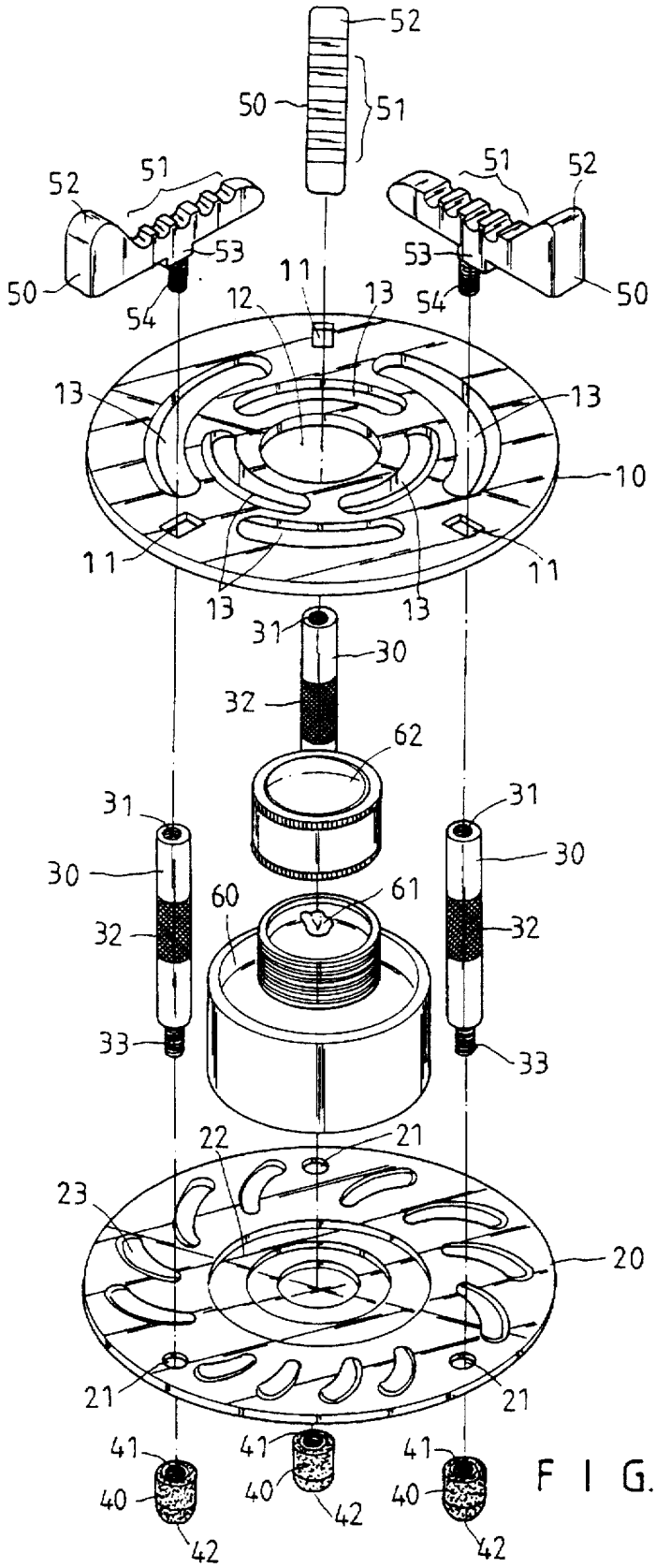
FIG. 1 is a perspective exploded view of a portable stove of a preferred embodiment in accordance with the invention.
Figure 2:
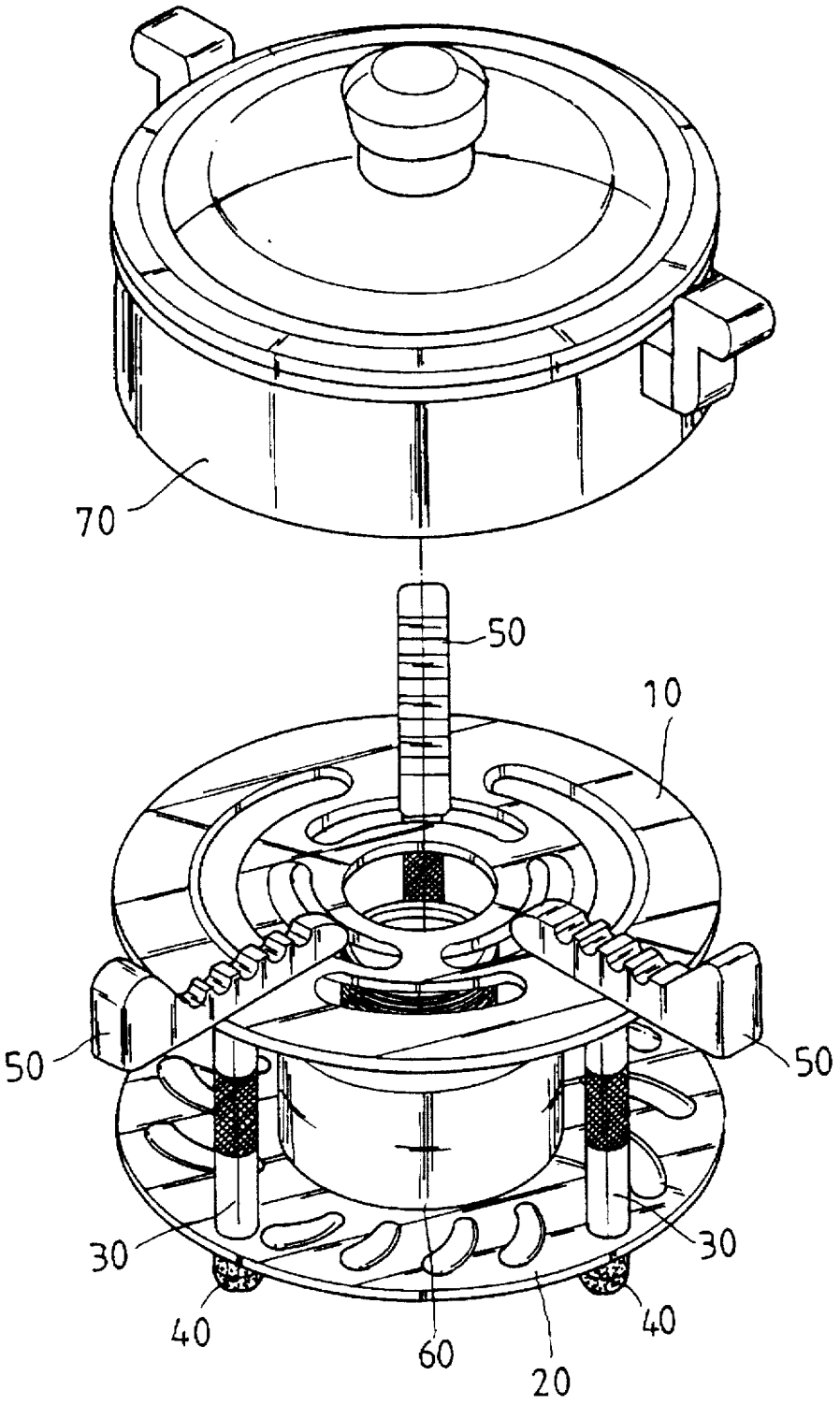
FIG. 2 is a perspective view of a portable stove and a boiler.
Figure 3:
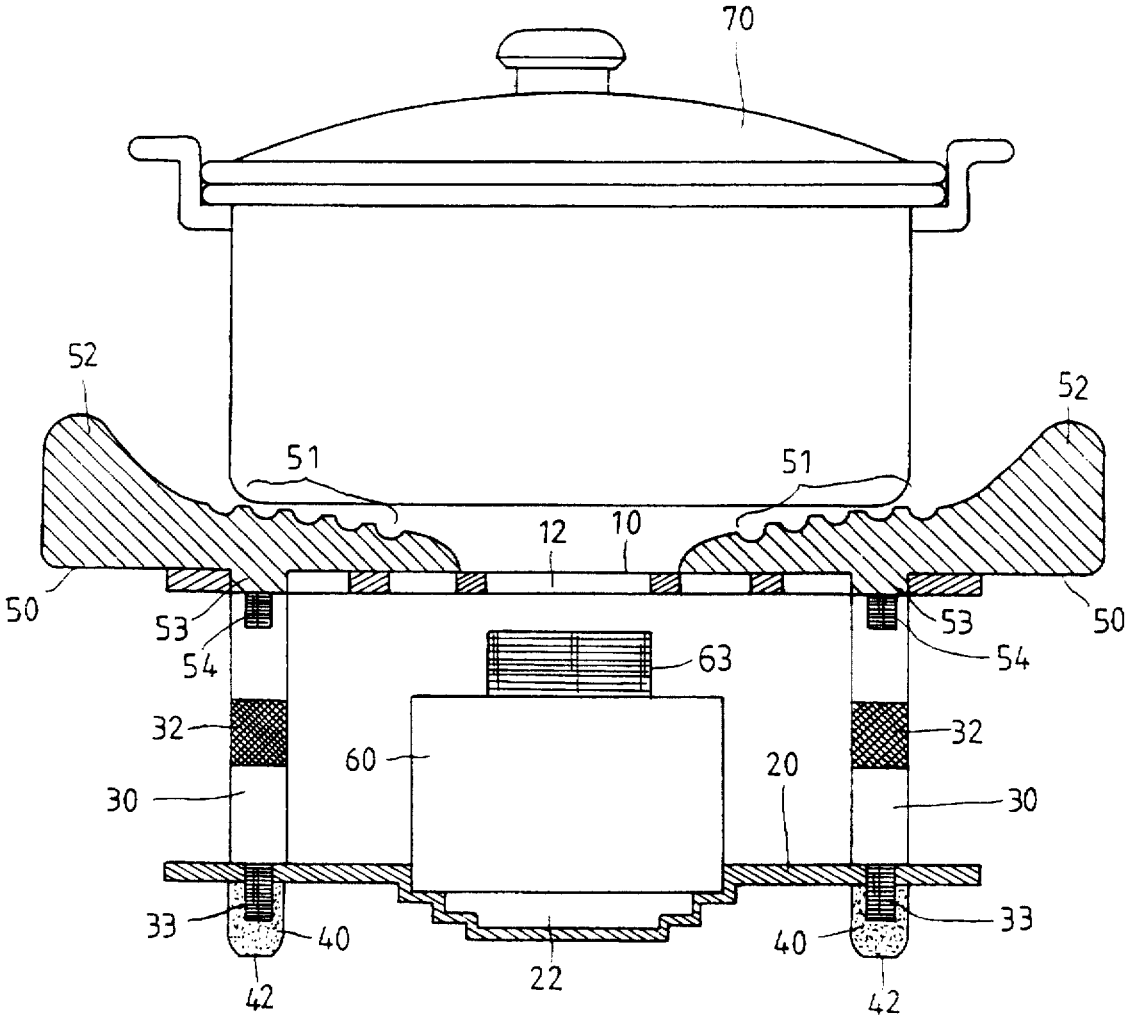
FIG. 3 is a sectional view of FIG. 2.

Referring to FIGS. 1 to 3, a portable stove has an upper disk 10, a lower disk 20, an oil can 60 and three support rods 30 disposed between the upper disk 10 and the lower disk 20. Three boiler support plates 50 are disposed on the upper disk 10. Each of the boiler support plates 50 has a lateral block 52, an indentation 51 formed on an upper face of each boiler support plate 50, a reatangular bottom protrusion 53 disposed beneath each boiler support plate 50, and a threaded post 54 disposed beneath each reatangular bottom protrusion 53. The upper disk 10 has three spaced rectangular holes 11 to receive the corresponding threaded posts 54 respectively, a plurality of vent holes 13 and a center hole 12. Each of the support rods 30 has an inner threaded hole 31 formed on an upper end of each support rod 30 to engage with the corresponding threaded post 54, an embossment 32 formed on a middle portion of each support rod 30 and a threaded end 33 disposed on a lower end of each support rod 30. The lower disk 20 has a center recess 23, three spaced round holes 21 to receive the corresponding threaded end 33 respectively, and a plurality of curved recesses 23. An oil can 60 is disposed on the center recess 23. A cylinder 63 is disposed on the oil can 60. A wick 61 is disposed in the cylinder 63. A cover 62 covers the cylinder 63. Three sockets 40 are disposed beneath the lower disk 20. Each of the sockets 40 has an inner threaded recess 41 to engage with the corresponding threaded end 33 respectively and a bottom 42 to contact the ground. A boiler 70 is disposed on the boiler support plates 50.

The sockets 40 can be unscrewed from the corresponding threaded ends 33 respectively. The oil can 60 is removed from the lower disk 20. The support rods 30 can be unscrewed from the corresponding threaded posts 54 respectively. The boiler support plates 50 can be removed from the upper disk 10.

The invention is not limited to the above embodiment but various modification thereof may be made. Further, various changes in form and detail may be made without departing from the scope of the invention.

I claim:

1. A portable stove comprising:

an upper disk, three boiler support plates disposed on said upper disk, each said boiler support plates having a lateral block, an indentation formed on an upper face of each said boiler support plates a rectangular bottom protrusion disposed beneath each said boiler support plate, and a threaded post disposed beneath each said rectangular bottom protrusion, said upper disk having three spaced rectangular holes to receive said corresponding threaded posts respectively, a plurality of vent holes and a center hole, a lower disk disposed under said upper disk, three support rods disposed between said upper disk and said lower disk, each said support rod having an inner threaded hole formed on an upper end of each said support rod to engage with each said corresponding threaded post respectively, and a threaded end disposed on a lower end of each said support rod, said lower disk having a center recess, three spaced round holes to receive said corresponding threaded end respectively, and a plurality of curved recesses, three sockets disposed beneath said lower disk, each said socket having an inner threaded recess to engage with said corresponding threaded end respectively.

2. A portable stove as claimed in claim 1, wherein an oil can is disposed on a center of said lower disk.

3. A portable stove as claimed in claim 2, wherein a cylinder is disposed on said oil can.

4. A portable stove as claimed in claim 3, wherein a wick is disposed in said cylinder.

5. A portable stove as claimed in claim 3, wherein a cover covers said cylinder.

* * * * *